US009963819B2

(12) United States Patent
Leibman et al.

(10) Patent No.: US 9,963,819 B2
(45) Date of Patent: May 8, 2018

(54) MULTI-STAGE FLUID ADDITIVE DISPENSER

(71) Applicant: General Electric Company, Schenectady, NY (US)

(72) Inventors: Alexander B. Leibman, Prospect, KY (US); John Joseph Roetker, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days. days.

(21) Appl. No.: 15/072,741

(22) Filed: Mar. 17, 2016

(65) Prior Publication Data

US 2017/0268152 A1 Sep. 21, 2017

(51) Int. Cl.

| | |
|---|---|
| ***D06F 39/02*** | (2006.01) |
| ***D06F 35/00*** | (2006.01) |
| ***D06F 39/00*** | (2006.01) |
| ***D06F 33/02*** | (2006.01) |

(52) U.S. Cl.

CPC ..... *D06F 39/02* (2013.01); *D06F 33/02* (2013.01); *D06F 35/006* (2013.01); *D06F 39/005* (2013.01)

(58) Field of Classification Search

CPC ..... D06F 39/02; D06F 39/022; D06F 39/028; D06F 39/088; D06F 39/12

USPC ..... 68/17 R, 207, 12.18, 12.13, 3 R; 222/132, 192, 204, 133, 136, 173, 416, 222/129, 145.1; 8/158, 137, 159

See application file for complete search history.

(56) References Cited

U.S. PATENT DOCUMENTS

| | | | | |
|---|---|---|---|---|
| 6,826,933 | B2 * | 12/2004 | Merkle | D06F 39/028 68/12.18 |
| 7,249,473 | B2 * | 7/2007 | Rizzeto | D06F 39/02 68/17 R |
| 7,322,216 | B2 * | 1/2008 | Favret | D06F 39/02 222/132 |
| 7,481,082 | B2 * | 1/2009 | Cho | D06F 39/028 68/17 R |
| 7,895,864 | B2 * | 3/2011 | Hill | D06F 39/02 68/12.18 |

(Continued)

FOREIGN PATENT DOCUMENTS

| | | | | |
|---|---|---|---|---|
| CN | 201136989 Y | | 10/2008 | |
| GB | 2187764 A | * | 9/1987 | D06F 39/02 |

*Primary Examiner* — David G Cormier
*Assistant Examiner* — Thomas Bucci
(74) *Attorney, Agent, or Firm* — Dority & Manning, P.A.

(57) ABSTRACT

An additive dispenser for a washing machine appliance is provided. The additive dispenser includes sidewalls and a bottom wall defining an additive reservoir. A first siphon and a second siphon are positioned within the additive reservoir. The first siphon defines a first peak and a first inlet. The second siphon defines a second peak and a second inlet. The first peak is defined at a lower vertical height than the second peak, and the first inlet is defined at a greater vertical height than the second inlet. Also provided are methods for operating a washing machine appliance having an additive dispenser, where the additive dispenser includes sidewalls and a bottom wall defining an additive reservoir, a first siphon defining a first inlet, and a second siphon defining a second inlet. The methods include opening and closing one or more valves to flow water to the additive reservoir of the dispenser.

1 Claim, 13 Drawing Sheets

(56) References Cited

U.S. PATENT DOCUMENTS

2005/0241072 A1* 11/2005 Kim ..... B08B 3/04
8/158
2009/0119849 A1* 5/2009 Hill ..... D06F 39/028
8/158

* cited by examiner

FIG. - 3C - PRIOR ART

FIG. - 3B - PRIOR ART

FIG. - 3A - PRIOR ART

MULTI-STAGE FLUID ADDITIVE DISPENSER

FIELD OF THE INVENTION

The subject matter of the present disclosure relates generally to additive dispensers for appliances, e.g., washing machine appliances.

BACKGROUND OF THE INVENTION

Washing machine appliances generally form wash and rinse fluids to clean clothing articles disposed within a wash basket of the appliance. The wash fluid can include, for example, water and various additives, e.g., detergent, fabric softener, and/or bleach. The additives can be mixed with water within a wash tub of the appliance to form the wash fluid. Various additives also may be added to water to form the rinse fluid.

To introduce one or more additives into the wash tub, a user can manually add the additive to the wash tub and/or the wash basket. For example, after starting the appliance, the user can pour detergent directly into the wash basket. Conversely, certain washing machine appliances include features for receiving additives and dispensing the additives during operation of the appliance. For example, an additive dispenser may be mounted to or directly beneath a top panel of a vertical axis washing machine appliance. The additive dispenser can receive an additive and direct the additive into a wash basket of the appliance. Similarly, a horizontal axis washing machine appliance can include an additive dispenser that receives an additive and directs the additive into a wash basket of the appliance.

Typically, the additive contained in the additive dispenser is flushed from the dispenser into the wash basket of the appliance through an influx of water into the dispenser. Usually, additive dispensers dispense a single dose of an additive during a wash or rinse cycle of the washing machine, i.e., the additive is dispensed once during a wash or rinse cycle. However, it may be desirable to dispense multiple doses of the additive, e.g., to dispense one portion of the additive at one point during a cycle of the washing machine and a second portion of the additive at a second, later point during the cycle. For example, the performance of an additive such as detergent may be enhanced by adding a portion of the detergent at the beginning of an agitation phase of a wash cycle and adding the remainder of the detergent at a later point in the agitation phase of the wash cycle, i.e., after articles within the wash basket have been agitated for a certain time period. Further, providing multiple additive doses from a single dispenser reservoir may efficiently utilize available space for the additive dispenser and may simplify a system for supplying water to the dispenser.

Accordingly, a washing machine appliance having features for dispensing an additive in multiple stages without requiring a complex additive dispenser or a complex system for providing water to the additive dispenser would be useful. Moreover, a method for operating a washing machine appliance having features for dispensing an additive in multiple stages would be advantageous. Also, a method for operating a washing machine appliance having features for dispensing an additive in multiple stages without requiring a complicated control methodology would be beneficial.

BRIEF DESCRIPTION OF THE INVENTION

Aspects and advantages of the invention will be set forth in part in the following description, or may be obvious from the description, or may be learned through practice of the invention.

In one exemplary embodiment of the present disclosure, an additive dispenser for a washing machine appliance is provided. The additive dispenser defines a vertical direction and a width direction. The additive dispenser includes sidewalls and a bottom wall. The sidewalls and the bottom wall define an additive reservoir. The additive dispenser further includes a first siphon positioned within the additive reservoir. The first siphon includes a first column and a first cap. The first column and the first cap define a first peak, and the first cap has a bottom positioned a first distance from the bottom wall to define a first inlet. The additive dispenser also includes a second siphon positioned within the additive reservoir. The second siphon includes a second column and a second cap. The second column and the second cap define a second peak, and the second cap has a bottom positioned a second distance from the bottom wall to define a second inlet. The first peak is defined at a lower vertical height than the second peak, and the first inlet is defined at a greater vertical height than the second inlet.

In another exemplary embodiment of the present disclosure, a method for operating a washing machine appliance having an additive dispenser is provided. The additive dispenser includes sidewalls and a bottom wall. The sidewalls and the bottom wall define an additive reservoir. The additive dispenser also includes a first siphon positioned within the additive reservoir. The first siphon includes a first column and a first cap, and the first cap has a bottom positioned a first distance from the bottom wall to define a first inlet. The additive dispenser further includes a second siphon positioned within the additive reservoir. The second siphon includes a second column and a second cap, and the second cap has a bottom positioned a second distance from the bottom wall to define a second inlet. The method includes opening a valve for a first time interval $t_{first}$ to flow a first volume of water to the additive reservoir; closing the valve; re-opening the valve for a second time interval $t_{second}$ to flow a second volume of water to the additive reservoir; and re-closing the valve.

In a further exemplary embodiment of the present disclosure, a method for operating a washing machine appliance having an additive dispenser is provided. The additive dispenser includes sidewalls and a bottom wall. The sidewalls and the bottom wall define an additive reservoir. The additive dispenser also includes a first siphon positioned within the additive reservoir. The first siphon includes a first column and a first cap, and the first cap has a bottom positioned a first distance from the bottom wall to define a first inlet. The additive dispenser further includes a second siphon positioned within the additive reservoir. The second siphon includes a second column and a second cap, and the second cap has a bottom positioned a second distance from the bottom wall to define a second inlet. The method includes opening a first valve to establish a flow of water to the additive reservoir at a first flow rate; opening a second valve such that the first and second valves are open concurrently, the open first and second valves establishing a flow of water to the additive reservoir at a second flow rate; and closing the first and second valves.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
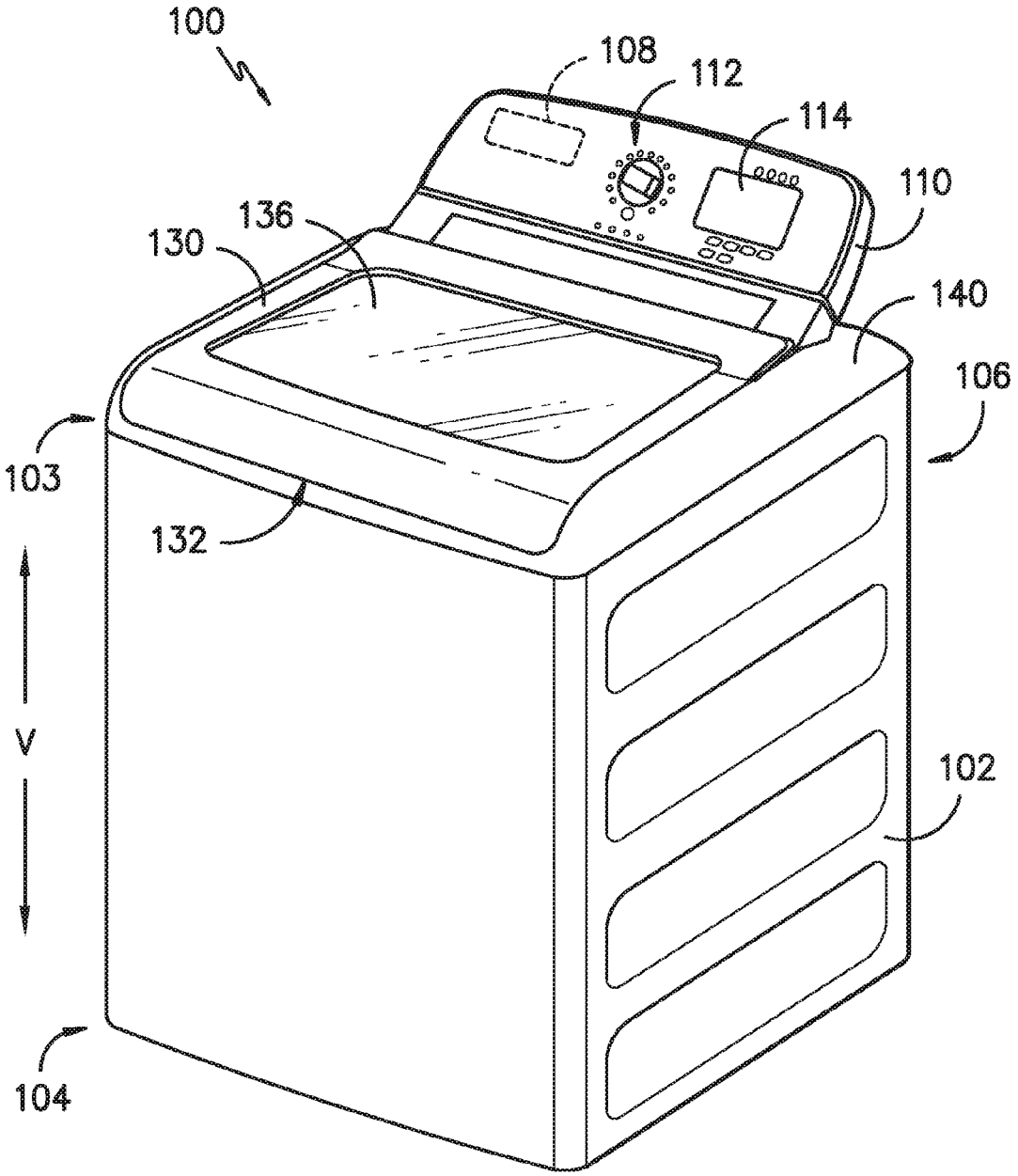
FIG. 1 provides a perspective view of a washing machine appliance according to an exemplary embodiment of the present subject matter, with a door shown in a closed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Further, each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
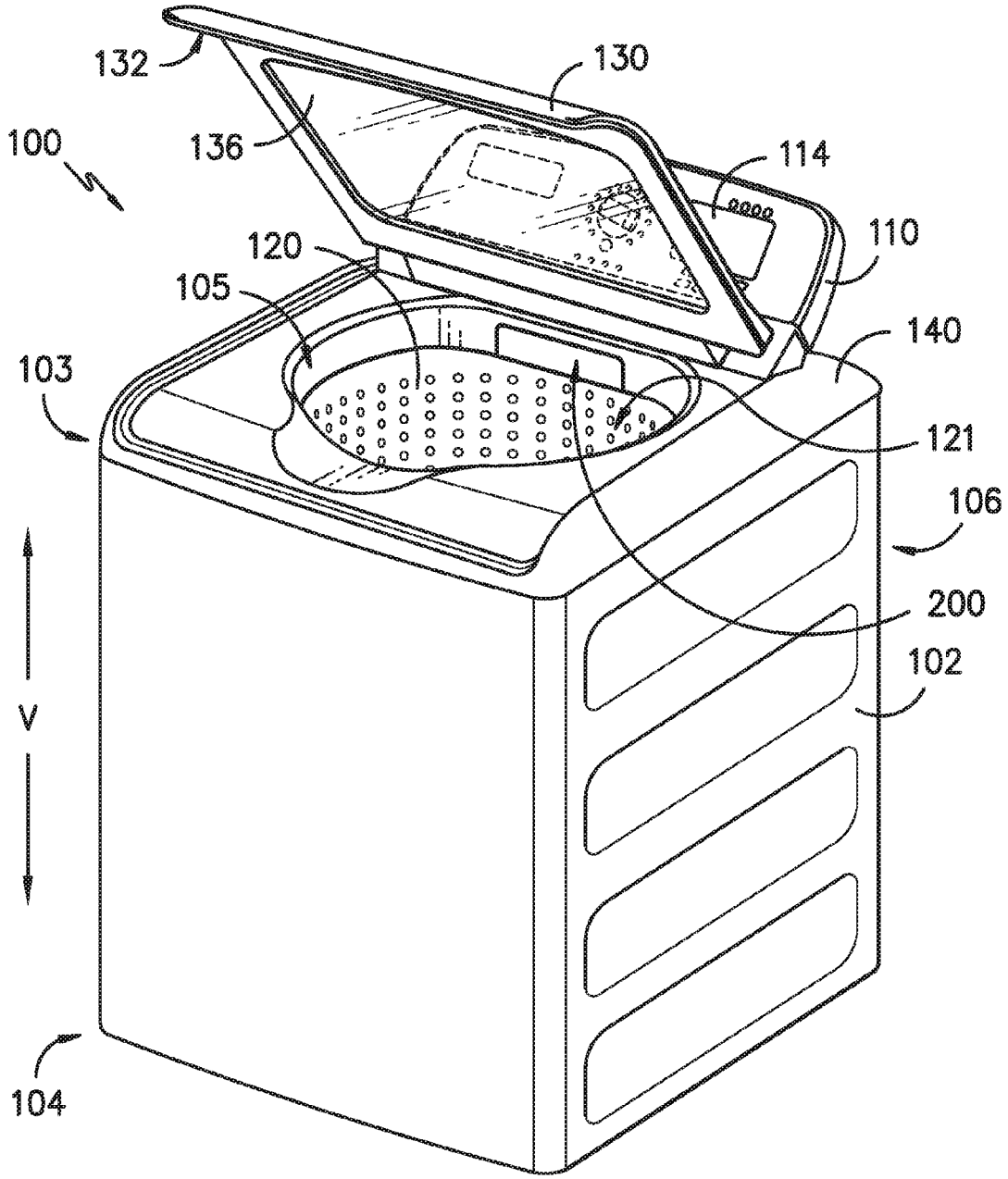
FIG. 2 provides a perspective view of the washing machine appliance of FIG. 1 with the door shown in an open position.

Referring now to the drawings, wherein identical numerals indicate the same elements throughout the figures, FIGS. 1 and 2 illustrate an exemplary embodiment of a vertical axis washing machine appliance 100. In FIG. 1, a lid or door 130 of washing machine 100 is shown in a closed position. In FIG. 2, door 130 is shown in an open position. While described in the context of a specific embodiment of vertical axis washing machine appliance 100, it should be understood that vertical axis washing machine appliance 100 is provided by way of example only. Other washing machine appliances having different configurations, different appearances, and/or different features, e.g., horizontal axis washing machines, may be utilized with the present subject matter as well.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

Top panel 140 includes at least one additive dispenser 200 (FIG. 2) for receipt of one or more additives, e.g., detergent, fabric softener, and/or bleach. While only one additive dispenser will be described herein, it will be understood that multiple additive dispensers may be used in alternative embodiments of the invention. Additive dispenser 200 is positioned near wash tub 121; in FIG. 2, dispenser 200 is depicted at a vertical position above wash tub 121 near back panel 106 of cabinet 102, but dispenser 200 could be positioned in other locations as well. Additive dispenser 200 is described in greater detail below.

In an illustrative embodiment, laundry items are loaded into wash basket 120 through opening 105, and washing operation is initiated through operator manipulation of input selectors 112. Wash basket 120 is filled with water and detergent and/or other additives from, e.g., dispenser 200, to form wash and rinse fluids. As shown in FIGS. 4 and 10-13, one or more valves can be arranged in a water supply system 150 and controlled by washing machine appliance 100 to provide water to dispenser 200. Water supply system 150 also may include one or more valves for filling wash basket 120 with fluid to the appropriate level for the amount of articles being washed and/or rinsed.

By way of example for a wash cycle, once wash basket 120 is properly filled with fluid, the contents of wash basket 120 can be agitated (e.g., with an impeller as discussed previously) for washing of laundry items in wash basket 120. After the agitation phase of the wash cycle is completed, wash basket 120 can be drained. Laundry articles can then be rinsed in a rinse cycle, e.g., by again adding fluid to wash basket 120 depending on the specifics of the cleaning cycle selected by a user. During the rinse cycle, the impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Figure 3:
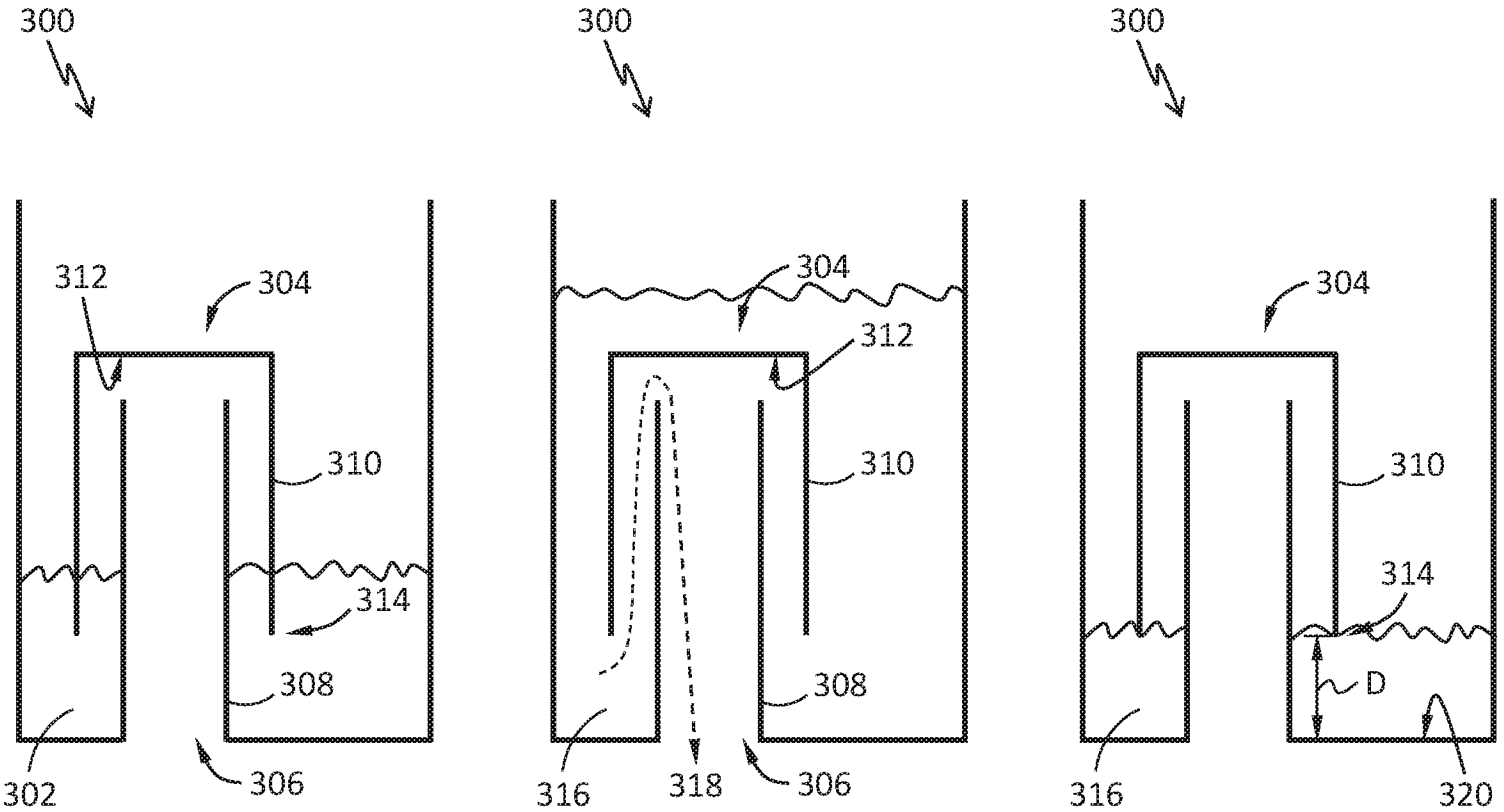
FIG. 3A provides a schematic view of a known additive dispenser with a quantity of an additive therein.
FIG. 3B provides a schematic view of the additive dispenser of FIG. 3A with water added to the quantity of additive therein.
FIG. 3C provides a schematic view of the additive dispenser of FIG. 3A with a mixture of water and washing additive remaining therein after dispensing a majority of the water and additive from the dispenser.

FIGS. 3A through 3C provide schematic views of a known configuration of an additive dispenser. More particularly, FIG. 3A provides a schematic view of a known additive dispenser 300 with a quantity of an additive 302 therein. That is, a user of the washing machine having dispenser 300 may add a quantity of additive 302, such as detergent, fabric softener, or the like, to dispenser 300 for dispensing during a wash or rinse cycle of the washing machine. A siphon 304 within dispenser 300 has an outlet 306 defined by a column 308. Siphon 304 also includes a cap 310 having an upper inner surface 312 and a bottom 314.

FIG. 3B provides a schematic view of the additive dispenser 300 with water added to the quantity of additive 302; the water and additive 302 form a fluid mixture 316 of water and additive. That is, water may be flowed to dispenser 300, and the water mixes with any additive within dispenser 300 to form mixture 316. As water is added, the level of mixture 316 within dispenser 300 rises. When mixture 316 reaches upper inner surface 312 of cap 310, mixture 316 begins to be drawn into column 308 such that the mixture 316 is siphoned from dispenser 300. As illustrated by arrow 318, mixture 316 flows from dispenser 300 through outlet 306. The fluid mixture may then flow to a wash basket of the washing machine appliance to form or be added to a wash or rinse fluid contained by a wash tub of the washing machine.

As depicted in FIG. 3C, after the flow of water to dispenser 300 is stopped, mixture 316 is dispensed from dispenser 300 until the level of the mixture reaches bottom 314 of cap 310, when siphoning ceases. As shown, a portion of mixture 316 remains within dispenser 300. It will be appreciated that the amount of mixture 316 that remains depends on a distance D between bottom 314 of cap 310 and a bottom wall or surface 320 of dispenser 300.

FIGS. 3A through 3C illustrate some limitations of present additive dispensers of washing machine appliances. For example, the mixture 316 of water and additive 302 is dispensed from the additive dispenser 300 only once. However, as described, it may be desirable to dispense an additive in multiple stages, e.g., at multiple points or times during a wash, rinse, or other cycle of the washing machine.

Figure 4:
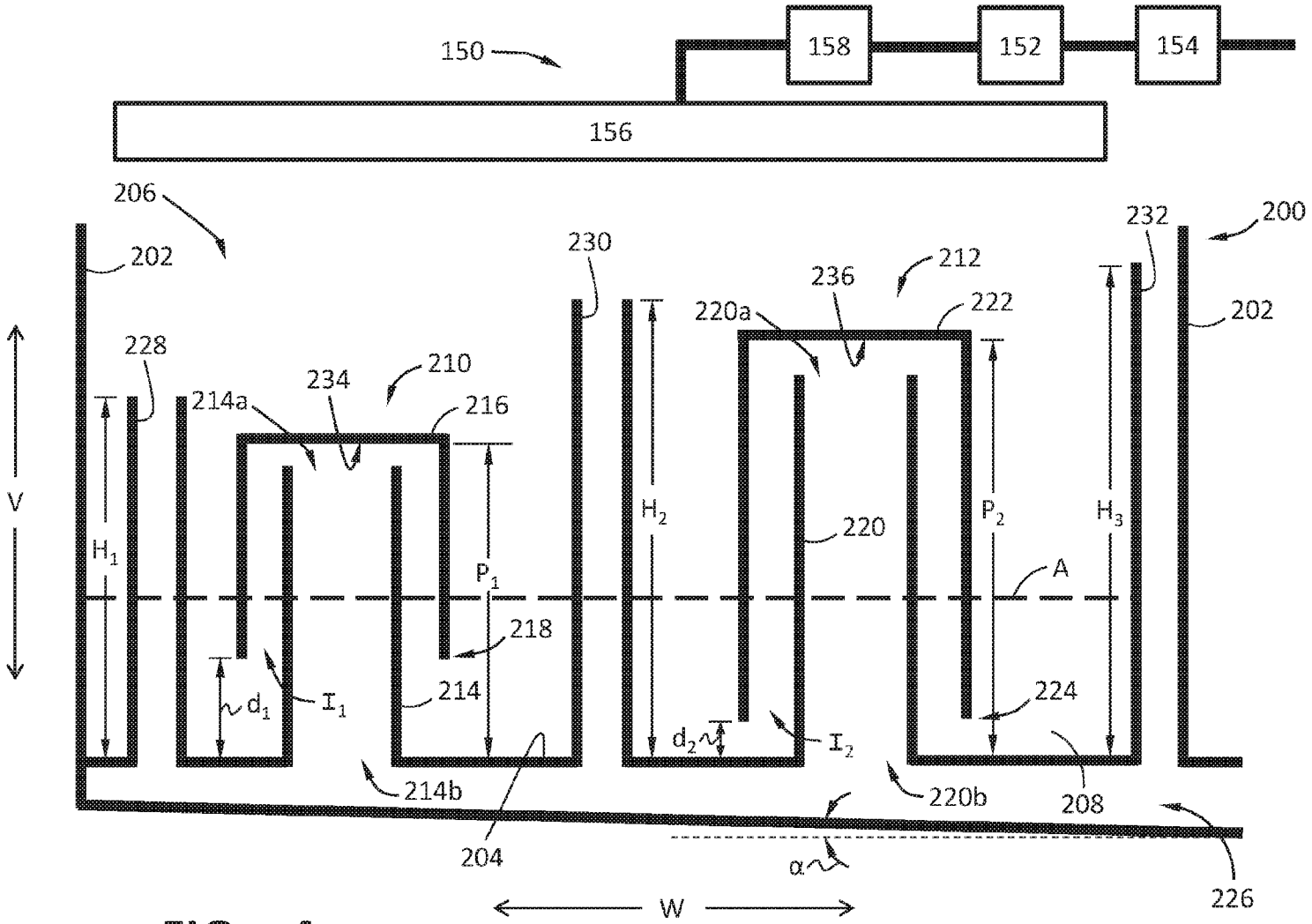
FIG. 4 provides a schematic view of an additive dispenser and water supply system according to an exemplary embodiment of the present subject matter, illustrating a fill line for an additive.

FIG. 4 is a schematic view of an additive dispenser 200 and a water supply system 150 according to an exemplary embodiment of the present subject matter. As shown, dispenser 200 includes sidewalls 202 extending along the vertical direction V and a bottom wall 204 extending along a width direction W. Sidewalls 202 and bottom wall 204 define an additive reservoir 206 for receipt of an additive 208, such as detergent, fabric softener, or the like, for dispensing during a wash and/or rinse cycle of washing machine appliance 100. A user of washing machine 100 may fill additive reservoir 206 with additive 208 up to an additive fill level A, which may be marked or indicated within reservoir 206 with a line or the like that indicates to the user a maximum additive fill level.

Dispenser 200 includes a first siphon 210 and a second siphon 212 positioned within reservoir 206 and spaced apart from one another along the width direction W. First siphon 210 includes a first column 214 and a first cap 216, which define a first peak $P_1$ from bottom wall 204 of dispenser 200. First cap 216 has a bottom 218 positioned a first distance $d_1$ from bottom wall 204 of additive dispenser 200. The first distance $d_1$ defines a first inlet $I_1$. First inlet $I_1$ permits ingress of fluid into siphon 210.

Second siphon 212 includes a second column 220 and a second cap 222, which define a second peak $P_2$ from bottom wall 204 of dispenser 200. Second cap 222 has a bottom 224 positioned a second distance $d_2$ from bottom wall 204 of additive dispenser 200 to define a second inlet $I_2$. Second inlet $I_2$ permits ingress of fluid into siphon 212. Further, as shown in FIG. 4, first peak $P_1$ defined by first siphon 210 is defined at a lower vertical height than second peak $P_2$ defined by second siphon 212. Conversely, first inlet $I_1$ defined by first cap 216 is defined at a greater (i.e., higher) vertical height than second inlet $I_2$ defined by second cap 222.

In alternative embodiments, additive dispenser 200 may include a different number of siphons, e.g., two, three, or more than three siphons, and/or a different arrangement of additive reservoir 206 for the receipt of one or more additives 208. Further, each siphon 210, 212 may be formed separately from dispenser 200 and then joined with dispenser 200. Alternatively, siphons 210, 212 may be integrally formed with dispenser 200 such that siphons 210, 212 and dispenser 200 are a single, unitary component.

As shown in FIG. 4, each column 214, 220 is open to permit a flow of fluid from additive reservoir to a dispenser conduit 226, from which the fluid may flow to wash basket 120 of washing machine 100. More specifically, first column 214 defines a first inlet 214*a* and a first outlet 214*b*; first inlet 214*a* permits an ingress of fluid from reservoir 206 into first column 214 and first outlet 214*b* permits an egress of fluid from first column 214 to dispenser conduit 226. Similarly, second column 220 defines a second inlet 220*a* and a second outlet 220*b*; second inlet 220*a* permits an ingress of fluid from reservoir 206 into second column 220 and second outlet 220*b* permits an egress of fluid from second column 220 to dispenser conduit 226. Dispenser conduit 226 may be defined by additive dispenser 200, but in other embodiments, dispenser conduit 226 may be defined in part by dispenser 200 and in part by another component of washing machine appliance 100. Also, dispenser conduit 226 may be at angle $\alpha$ with respect to the width direction W to assist the flow of fluid to wash basket 120.

Continuing with FIG. 4, additive dispenser 200 further includes a number of overflow passages. In particular, dispenser 200 includes a first overflow 228 having a first height $H_1$; the height $H_1$ of first overflow 228 is greater than the first peak $P_1$ but less than the second peak $P_2$. Dispenser 200 also includes a second overflow 230 having a second height $H_2$. The height $H_2$ of second overflow 230 is greater than the second peak $P_2$ but less than a third height $H_3$ of a third overflow 232. The overflows 228, 230, and 232 may be provided to help dispense fluid from additive dispenser reservoir 206 such that the fluid does not flow into portions of washing machine appliance 100 other than wash basket 120 and tub 121. For example, if too much or too large a volume of water is added to reservoir 206 because a valve becomes stuck open, overflows 228, 230, 232 may help direct the fluid to wash basket 120 rather than within cabinet 102 outside of wash tub 121 and onto machinery for operating washing machine 100 and/or onto a floor on which washing machine 100 rests. Moreover, first overflow 228 also may help prevent a second stage of dispensing an additive, further described below, from occurring before it should.

As further shown in FIG. 4, water supply system 150 includes a first valve 152 and a second valve 154. First valve 152 and second valve 154 control a flow of water F from a water supply (not shown) to a water outlet 156, from which water flows to additive reservoir 206 of dispenser 200. Water outlet 156 may include a diffuser or shower plate for generally evenly distributing water to additive reservoir 206. Water supply system 150 also includes a flow meter 158 for determining a flow rate of water from the water supply system 150 to additive dispenser 200. For example, flow meter 158 may measure a pressure of water flowing through meter 158 to determine the flow rate of the water. Of course, any suitable flow meter 158 may be used, i.e., other ways of determining the flow rate using flow meter 158 may be used as well. In alternative embodiments, water supply system 150 may comprise a different number of valves for controlling the flow of water to dispenser 200, and in some embodiments, flow meter 158 may be omitted. Some alternative embodiments, e.g., one embodiment employing one valve 152 and flow meter 158 and another embodiment employing first and second valves 152, 154 without flow meter 158, are described below.

Figure 5:
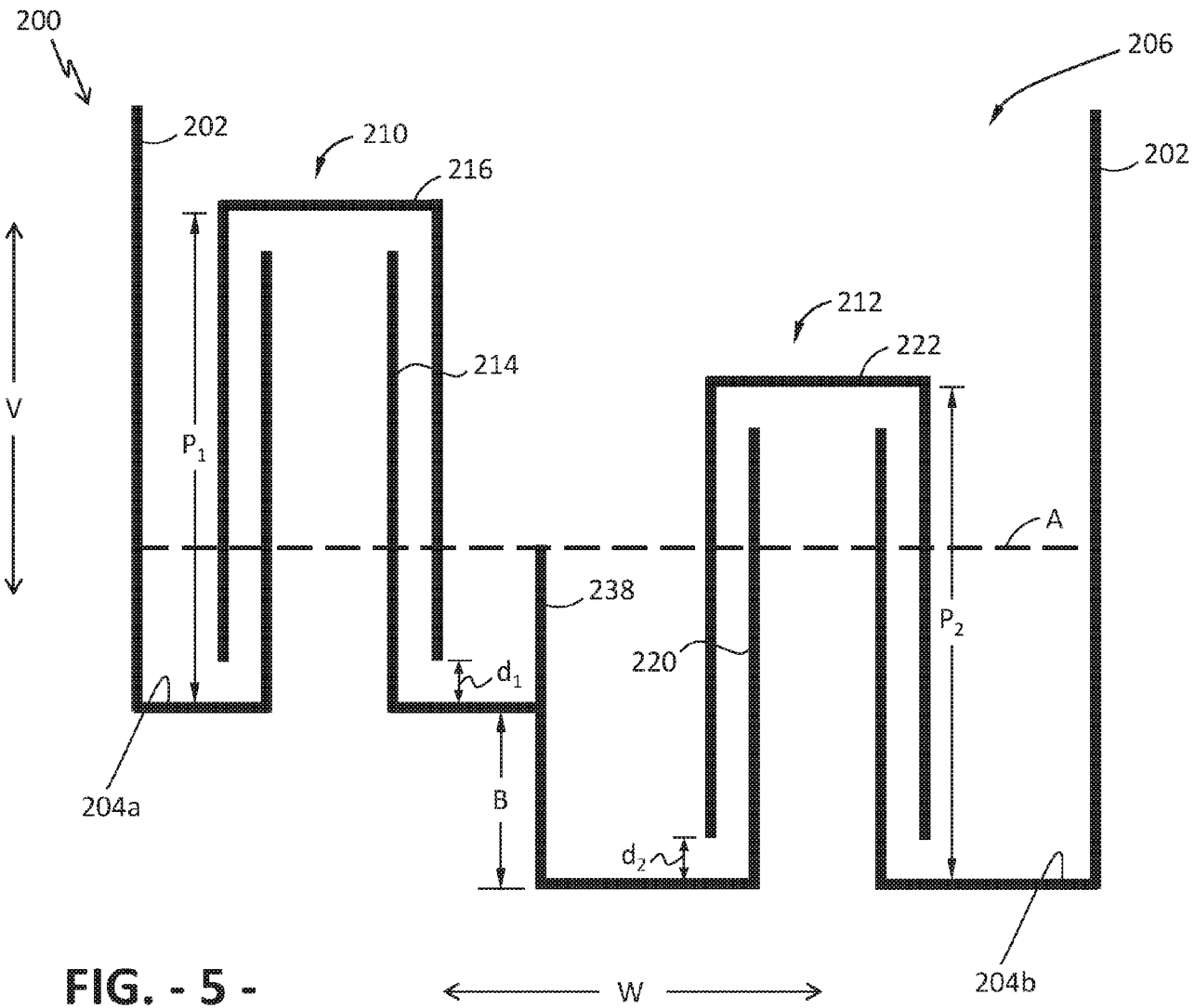
FIGS. 5, 6, and 7 provide schematic views of an additive dispenser according to other exemplary embodiments of the present subject matter.
Figure 6:
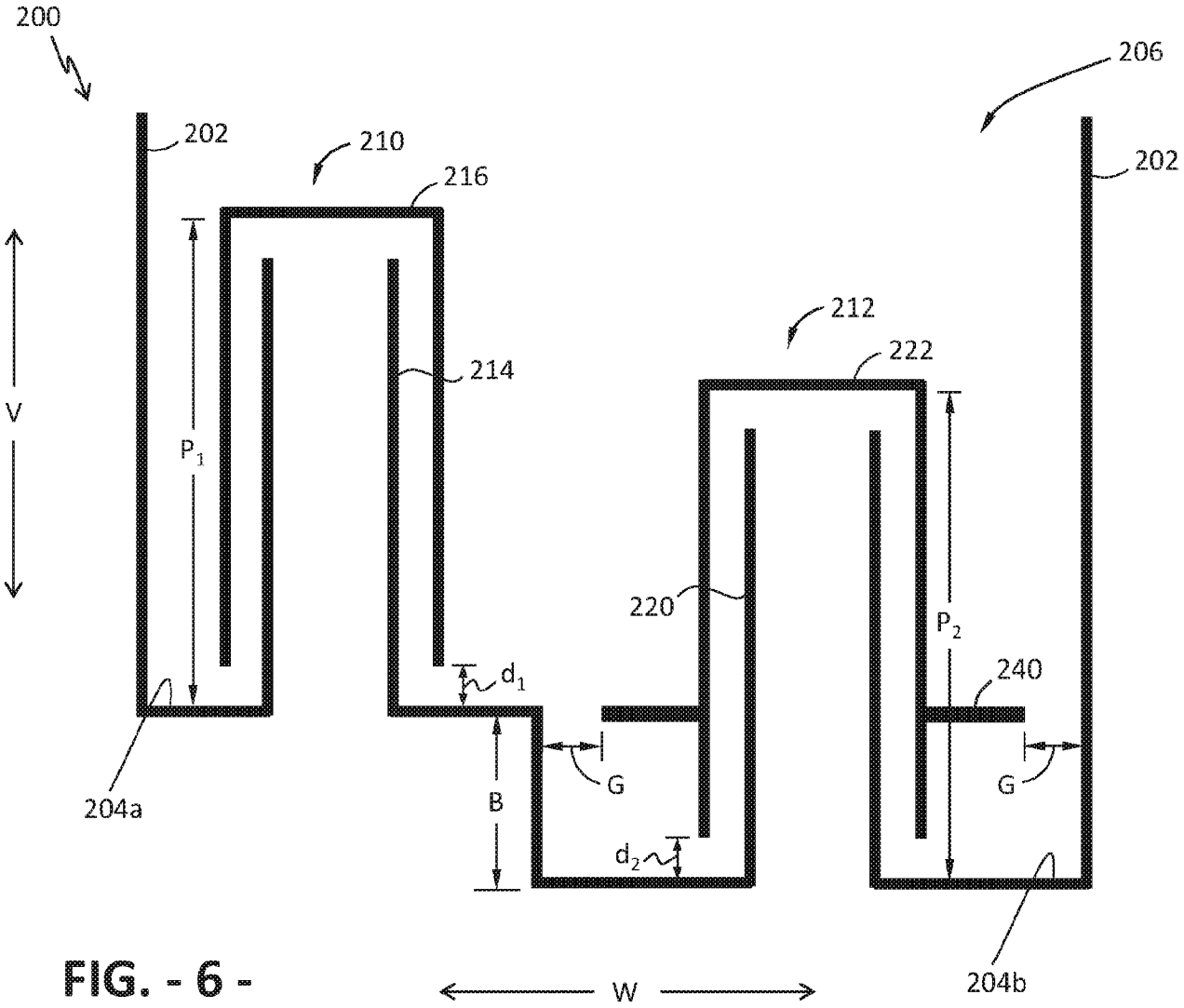
Figure 7:
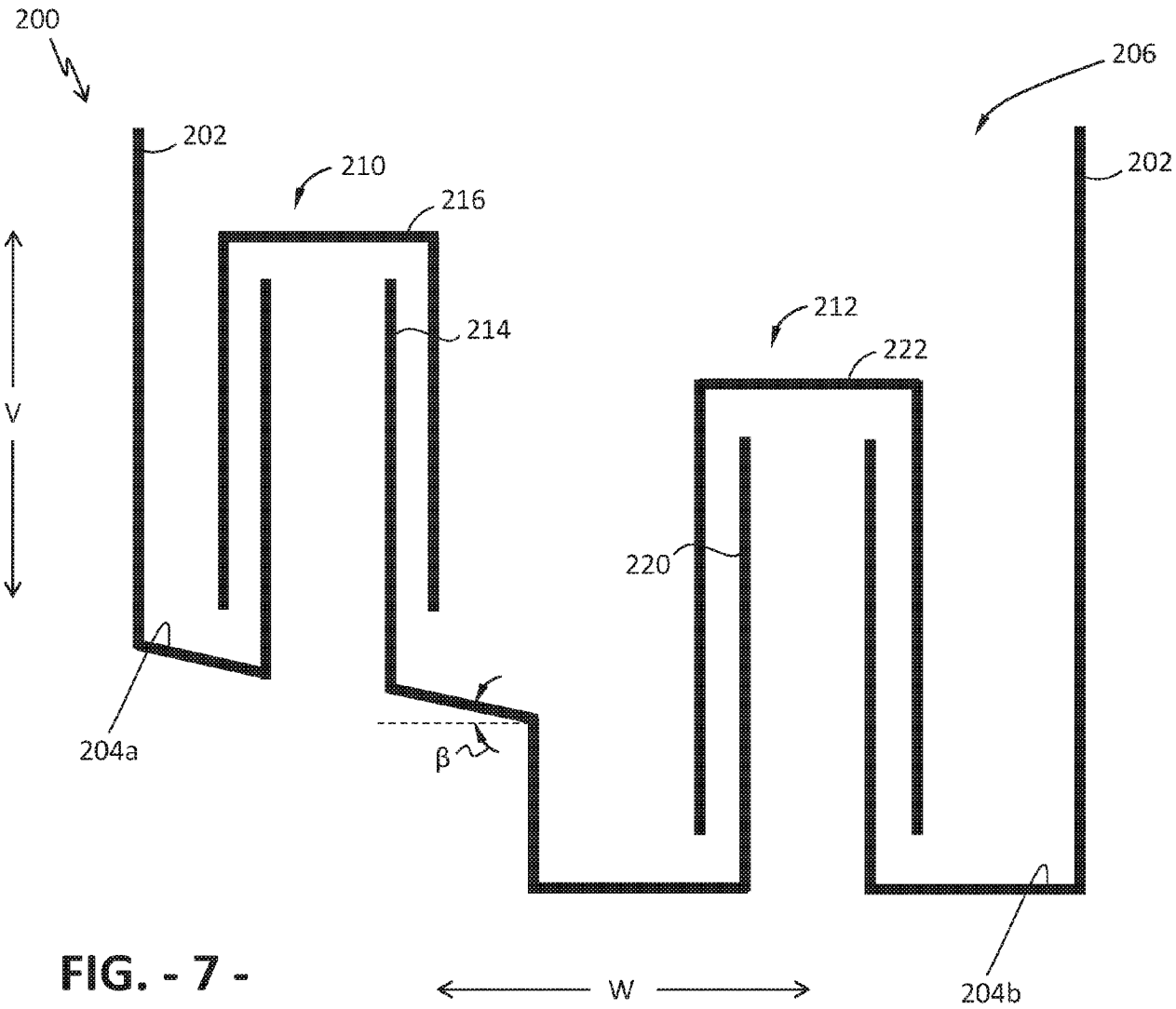

Referring now to FIGS. 5, 6, and 7, schematic views of additive dispenser 200 according to other embodiments of the present subject matter are provided. As shown in FIG. 5, in some embodiments of additive dispenser 200, bottom wall 204 may comprise a first portion 204*a* and a second portion 204*b*. First portion 204*a* of bottom wall 204 is at a position that is vertically above second portion 204*b* of the bottom wall. More particularly, first portion 204*a* extends along the width direction W at a height B above second portion 204*b*, which also extends along the width direction W. First siphon 210 is positioned within additive reservoir 206 adjacent first portion 204*a* of bottom wall 204 and second siphon 212 is positioned within additive reservoir 206 adjacent second portion 204*b* of bottom wall 204. More specifically, first siphon 210 extends from first portion 204*a*, such that the first distance $d_1$ is measured between first portion 204*a* of bottom wall 204 and bottom 218 of first cap 216. Similarly, second siphon 212 extends from second portion 204*b*, such that the second distance $d_2$ is measured between second portion 204*b* of bottom wall 204 and bottom 224 of second cap 222.

As further depicted in FIG. 5, an interior wall 238 extends vertically between first portion 204*a* and second portion 204*b* such that interior wall 238 extends into additive reservoir 206. Interior wall 238 may extend into additive reservoir 206 at a height that defines the additive fill level A. Further, in some embodiments of additive reservoir 200 having siphons 210, 212 positioned at different heights within reservoir 206 as shown in FIG. 5, first siphon 210 and second siphon 212 may be dimensionally identical. That is, the first peak $P_1$ defined by first siphon 210 may be equal to the second peak $P_2$ defined by second siphon 212, and the distance $d_1$ between first portion 204*a* of bottom wall 204 and first cap 216 may be equal to the distance $d_2$ between second portion 204*b* of bottom wall 204 and second cap 222. In other embodiments, siphons 210, 212 may be dimensionally dissimilar, e.g., even if second siphon 212 is positioned on lower portion 204*b* of bottom wall 204, second peak $P_2$ defined by second siphon 212 may be vertically higher (i.e., at a greater vertical height) than first peak $P_1$ of first siphon 210 positioned on upper portion 204*a* of bottom wall 204.

Turning now to FIG. 6, in other exemplary embodiments of additive dispenser 200, interior wall 238 may be omitted between first and second portions 204*a*, 204*b* of bottom wall 204. Without interior wall 238, additive 208 and/or an additive-water mixture M may tend to flow toward second siphon 212 positioned on the lower, second portion 204*b* of bottom wall 204. As shown in FIG. 7, in some embodiments of dispenser 200, first portion 204*a* of bottom wall 204 also may be at an angle $\beta$ with respect to the width direction W to help additive 208 and/or mixture M flow toward second siphon 212. In embodiments of dispenser 200 where interior wall 238 is omitted, the portion of reservoir 206 having the lower portion 204*b* of bottom wall 204 may be screened from or invisible to the view of a user of washing machine 100. Because in such embodiments additive and/or mixture M tend to flow toward the lower side or portion of reservoir 206, residual additive may accumulate within the lower portion, and the residual additive may give dispenser 200 the appearance of being dirty, which may be undesirable. Accordingly, by screening the lower portion from the user's view, or from prohibiting or blocking the lower portion from view, dispenser 200 may have a generally clean appearance to the user because only the upper portion is visible.

Referring back to FIG. 6, second siphon 212, which is positioned at a vertical height B below first siphon 210, may include a skirt 240 extending about second cap 222. Skirt 240 may impede the dilution of additive 208 as water is delivered to additive reservoir 206 to establish siphoning through second siphon 212 or both siphons 210, 212. Skirt 240 may extend outward from cap 222 such that a gap G is defined between skirt 240 and the nearest sidewalls 202 and skirt 240 and first portion 204*a* of bottom wall 204.

The alternative embodiments of additive dispenser 200 illustrated in FIGS. 5, 6, and 7 are provided by way of example only but may provide some flexibility in the configuration of a dispenser 200 for dispensing an additive in multiple stages using one dispenser reservoir. For example, by varying the height of bottom wall 204 of dispenser 200, the advantages of utilizing siphons having different peak heights and cap lengths may be achieved while also reducing sensitivity to variations in water supply pressure, which can affect the reliability or robustness of multi-stage dispenser 200. Moreover, although FIGS. 5, 6, and 7, do not illustrate any of overflows 228, 230, 232, it will be appreciated that overflows 228, 230, 232 may be included in the embodiments depicted in FIGS. 5, 6, and 7. Additionally, other configurations of additive dispenser 200 also may be used, e.g., dispenser 200 may have more than two siphons, etc.

Figure 8:
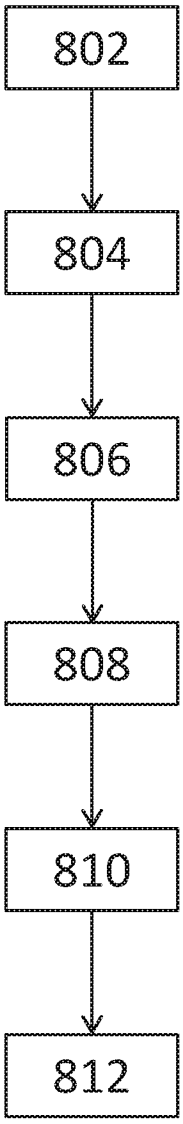
FIG. 8 provides a chart illustrating a method for operating a washing machine appliance according to an exemplary embodiment of the present subject matter.
Figure 9:
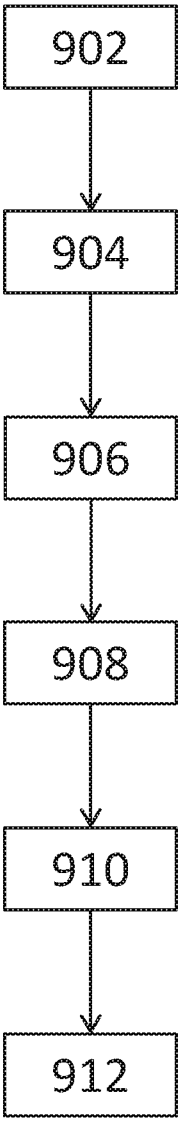
FIG. 9 provides a chart illustrating another method for operating a washing machine appliance according to an exemplary embodiment of the present subject matter.

Referring now to FIGS. 8 and 9, methods for operating washing machine appliance 100 according to exemplary embodiments of the present subject matter are provided. Generally, methods 800 and 900 are methods for operating washing machine 100 to dispense an additive in multiple stages, i.e., for dispensing a portion of an additive within an additive dispenser at one point during a cycle of washing machine 100 and then dispensing the remainder of the additive at a second point during the cycle. Of course, the method may comprise more than two stages of dispensing the additive. Further, although described below as performed at least in part by controller 108, it should be appreciated that methods 800 and 900 may be performed in whole or in part by controller 108 or any other suitable device or devices.

Turning to FIG. 8, at step 802 of method 800, a cycle of washing machine appliance 100 is initiated. The cycle may be a wash cycle or a rinse cycle, or any other cycle of washing machine 100 in which an additive, such as detergent, fabric softener, pre-wash treatment, bleach, or the like, may be used. As an example, the cycle may be a wash cycle, and initiating the wash cycle may include filling or starting to fill wash basket 120 with water. At step 804, first valve 152 is opened to for a first time interval $t_{first}$ to flow a first volume of water to additive reservoir 206. To determine when the time interval $t_{first}$ has elapsed, either of step 802 or step 804 also may include starting a timer. In some embodiments, valve 152 may be cycled opened and closed rather than being open continuously for the period of time $t_{first}$. Stated differently, at step 804, valve 152 may be cycled between opened and closed until the total time valve 152 has been opened equals the time interval $t_{first}$.

After a time $t_{first}$ has elapsed, valve 152 is closed, as illustrated at step 806. In some embodiments, the time interval $t_{first}$ may be a predetermined time interval that is programmed into controller 108. In other embodiments, time $t_{first}$ may be determined based on the flow rate of water from valve 152 as measured or determined from readings by flow meter 158. Whether valve 152 is cycled during step 804 or is continuously open, valve 152 is closed at step 806 after time interval $t_{first}$ has elapsed and the first volume of water is flowed to additive reservoir 206, i.e., controller 108 closes valve 152 after the first volume of water has been delivered to additive dispenser 200. It will be appreciated that the first volume is determined by the flow rate of water and time interval $t_{first}$.

Figure 10:
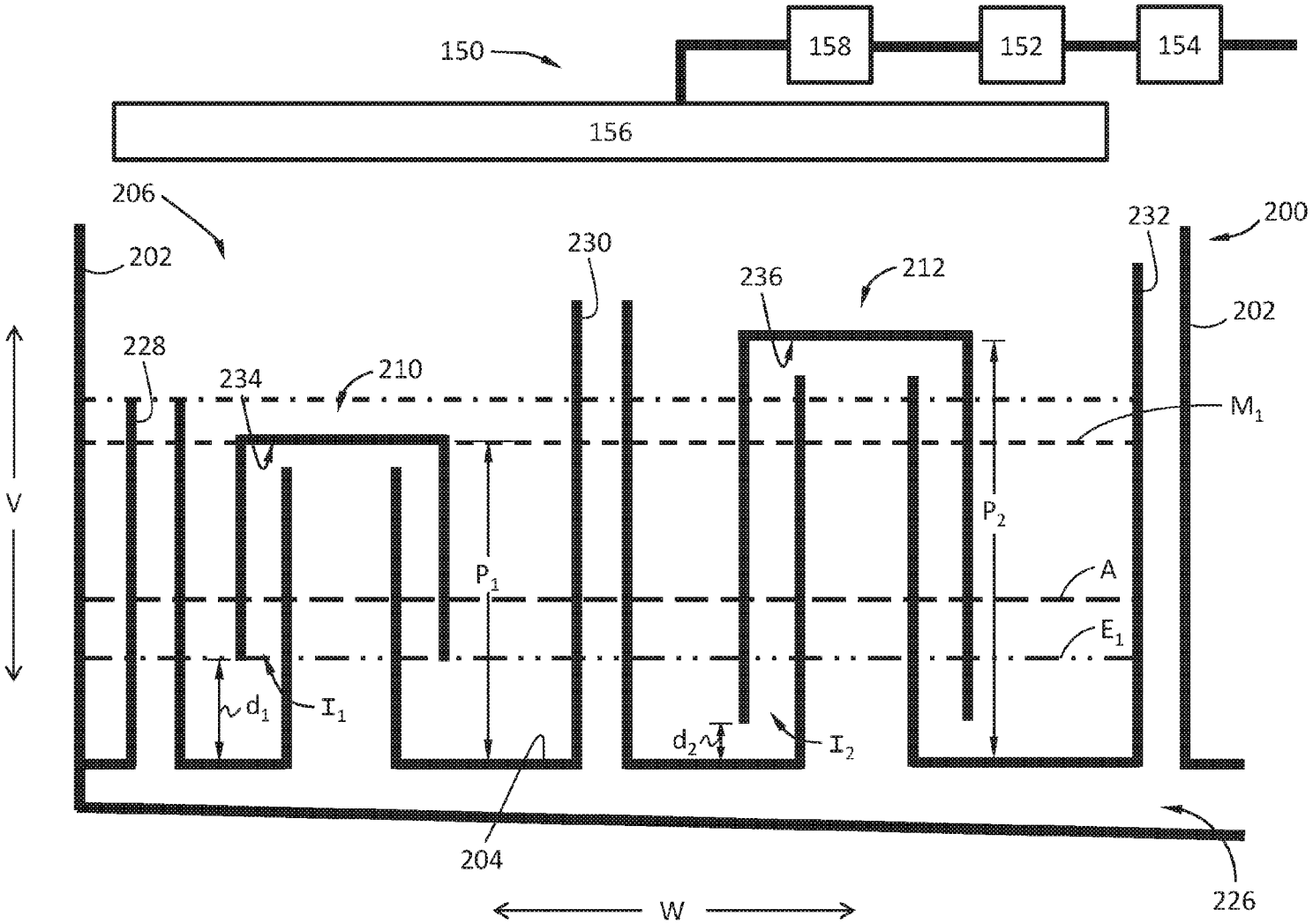
FIG. 10 provides a schematic view of the additive dispenser of FIG. 4, illustrating various fill levels of a first stage of dispensing an additive.

The first volume of water may be sufficient to establish siphoning of fluid from additive dispenser 200 through first siphon 210. More particularly, water flowing from valve 152 to additive reservoir 206 through water outlet 156 mixes with additive 208 within reservoir 206 to form a fluid mixture M. As shown in FIG. 10, flowing the first volume of water to reservoir 206 may raise the fluid level within reservoir 206 to a first mixture level $M_1$. At first mixture level $M_1$, the fluid has reached an upper inner surface 234 of first cap 216 such that first siphon 210 is primed and siphoning of mixture M is established through first siphon 210. As mixture M is siphoned from additive reservoir 206, mixture M flows through first outlet 214*b* and into dispenser conduit 226, which conveys the mixture M of water and additive 208 toward wash basket 120 and any articles therein.

Referring still to FIG. 10, delivering the first volume of water to reservoir 206 is sufficient to establish siphoning through only first siphon 210. The first peak $P_1$ of first siphon 210 is less than the second peak $P_2$ of second siphon 212; as such, a volume of fluid sufficient to establish siphoning through first siphon 210 need not establish siphoning through second siphon 212. Further, as described above, first overflow 228 may help dispense additive mixture M from additive dispenser 200 to avoid establishing siphoning through second siphon 212 after the first volume of water is delivered to reservoir 206. As also illustrated in FIG. 10, siphoning through first siphon 210 ends when the fluid level within reservoir 206 declines to a first end level $E_1$ at first inlet $I_1$. At first end level $E_1$, the fluid has reached bottom 218 of first cap 216 such that the fluid pressure of mixture M is insufficient to overcome the pressure within first column 214 and siphoning through first siphon 210 stops. Accordingly, a portion of mixture M has been siphoned through first siphon 210 and dispensed to wash basket 120, and another portion of mixture M remains within reservoir 206.

Opening and closing valve 152 to flow a first volume of water to additive reservoir 206, which mixes with additive 208 within reservoir 206 to form mixture M that is siphoned through first siphon 210, defines a first stage of dispensing additive 208 to wash basket 120. As part of the cycle that was initiated at step 802, the contents of wash basket 120 may be agitated, spun, or otherwise manipulated during the first stage of dispensing the additive or before proceeding to the second stage of dispensing the additive. For example, if the cycle is a wash cycle, the first stage of dispensing additive 208 may occur as wash basket 120 is filled with water. More particularly, when the wash cycle is initiated at step 802, wash basket 120 may begin to be filled with water, and steps 804 and 806 of opening and closing valve 152 to flow the first volume of water to additive reservoir 206 may be performed as wash basket 120 is being filled with water. As such, a first portion of water-additive mixture M is dispensed to wash basket 120 prior to an agitation phase of the wash cycle or as the agitation phase begins. In some embodiments, the contents of wash basket 120 are agitated after the first volume of water has been flowed to reservoir 206 and the first portion of mixture M has been dispensed and before another portion of mixture M is dispensed to wash basket 120 as described below.

Referring back to FIG. 8, valve 152 is re-opened for a second time interval $t_{second}$ to flow a second volume of water to additive reservoir 206, as illustrated at step 808. As shown as step 810, valve 152 is re-closed after the time interval $t_{second}$ has elapsed. Like time interval $t_{first}$, in some embodiments time interval $t_{second}$ may be a predetermined time interval that is programmed into controller 108. In other embodiments, time interval $t_{second}$ may be determined based on the flow rate of water from valve 152 as measured or determined from readings by flow meter 158. Further, time interval $t_{second}$ may be greater than time interval $t_{first}$, and/or valve 152 may not be cycled while delivering the second volume of water to reservoir 206, such that the second volume of water is larger or greater than the first volume of water. It will be understood that the second volume of water is determined by the flow rate of water and the second time interval $t_{second}$.

Figure 11:
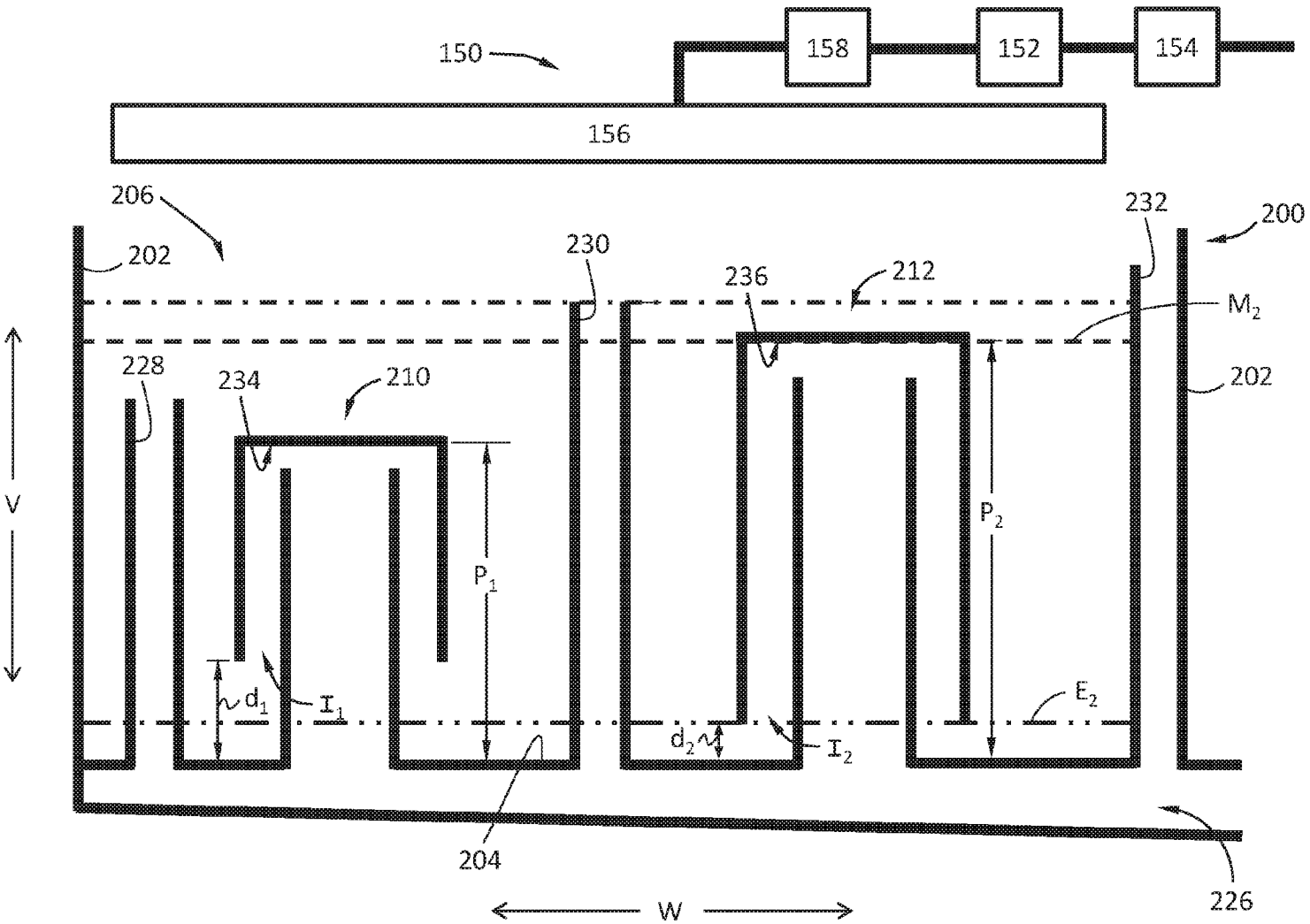
FIG. 11 provides a schematic view of the additive dispenser of FIG. 4, illustrating various fill levels of a second stage of dispensing an additive.

Because the second volume of water is greater than the first volume, the second volume of water may be sufficient to establish siphoning of fluid from additive dispenser 200 through first siphon 210 and second siphon 212. More specifically, water flowing from valve 152 to additive reservoir 206 through water outlet 156 mixes with the water-additive mixture M remaining within reservoir 206, forming more fluid mixture M. As shown in FIG. 11, flowing the second volume of water to reservoir 206 may raise the fluid level within reservoir 206 to a second mixture level $M_2$. At second mixture level $M_2$, the fluid has reached an upper inner surface 236 of second cap 222 such that second siphon 212 is primed and siphoning of mixture M is established through second siphon 212. Thus, the second volume of water is larger than the first volume of water, as the second volume raises the fluid level at least to the height of second peak $P_2$ defined by second siphon 212, which is greater or higher than the first peak $P_1$ defined by first siphon 210. Further, it should be understood that, at a fluid level $M_2$, first siphon 210 also is primed, and siphoning of mixture M is established through first siphon 210 as well. As mixture M is siphoned from additive reservoir 206, mixture M flows through first outlet 214*b* and second outlet 220*b* and thereby into dispenser conduit 226, which conveys the mixture M of water and additive 208 toward wash basket 120 and any articles therein.

Further, if the fluid within reservoir 206 rises to or above the height $H_2$ of second overflow 230, second overflow 230 may help dispense additive mixture M from additive dispenser 200 to avoid overflowing reservoir 206. Additionally, if the fluid within reservoir 206 rises to or above the height $H_3$ of third overflow 232, third overflow 232 also may help dispense additive mixture M from additive dispenser 200 to avoid overflowing reservoir 206.

As also illustrated in FIG. 11 and described above, siphoning through first siphon 210 ends when the fluid level within reservoir 206 declines to first end level $E_1$. Moreover, because the distance $d_2$ between bottom 224 of second cap 222 and bottom wall 204 of dispenser 200 is less than the distance $d_1$ between bottom 218 of first cap 216 and bottom wall 204, siphoning through second siphon 212 ends when the fluid level within reservoir 206 further declines to a second end level $E_2$, which is closer to bottom wall 204 than is first end level $E_1$. At second end level $E_2$, the fluid has dropped to second inlet $I_2$, such that the fluid pressure of mixture M is insufficient to overcome the pressure within second column 220 and siphoning through second siphon 212 stops. Accordingly, a second portion of mixture M has been siphoned through first and second siphons 210, 212 and dispensed to wash basket 120, and only a small portion of mixture M remains within reservoir 206.

In short, a second stage of dispensing additive 208 to wash basket 120 is defined by opening and closing valve 152 to flow the second volume of water to additive reservoir 206, as the water mixes with mixture M within reservoir 206 to form additional mixture M that is siphoned through first and second siphons 210, 212 and thereby flows to wash basket 120. Therefore, by utilizing siphons 210, 212 having different peak heights $P_1$, $P_2$, an additive can be dispensed from additive dispenser 200 in a first stage and a second stage, which are based on the amount of water delivered to reservoir 206. That is, water may be delivered to the dispenser in timed intervals to dispense the additive in multiple stages.

At step 812, the cycle of washing machine appliance 100 is completed. For example, if the cycle is a wash cycle, the contents of wash basket 120 can be agitated for a period of time; in some embodiments, the second stage of dispensing additive 208 occurs during the agitation phase of the wash cycle, such that the agitation phase is completed after the second stage of dispensing. After the agitation phase of the wash cycle is completed, wash basket 120 can be drained. Other cycles, such as a rinse cycle and a spin cycle, may then be performed.

As described, the first and second time intervals $t_{first}$ and $t_{second}$ may be predetermined time intervals or may be determined from the flow rate of water through flow meter 158. However, water supplied to water supply system 150 usually is supplied at pressures that vary from one water supply to another, e.g., water supplied to water supply system 150 may vary from about 20 pounds per square inch (psi) to about 120 psi and typically is supplied at a pressure between about 40 psi and about 60 psi. As such, the flow rate of water through water supply system 150 may vary about two to about three gallons per minute (gpm) between different washing machines 100. Accordingly, without relying on the flow rate of water through system 150, i.e., using a predetermined time interval $t_{first}$, the first volume of water delivered to additive dispenser 200 may be different from one washing machine to the next. However, by determining the flow rate using flow meter 158 and calculating the time $t_{first}$ based on the flow rate, the first volume may be the same between washing machine appliances. Similarly, whether the time interval $t_{second}$ is the same for each machine or is calculated based on the flow rate, the second volume may vary or be the same between washing machines. Of course, by basing the times $t_{first}$ and $t_{second}$ on the flow rate, valve 152 may be closed at different times in different iterations of method 800, such that the first stage and second stage of dispensing an additive may occur at and extend over different time periods for different washing machines.

Turning now to FIG. 9, method 900 provides a method for operating washing machine appliance to dispense an additive in multiple stages that is less sensitive to differences in water supply pressure. At step 902 of method 900, a cycle of washing machine appliance 100 is initiated. The cycle may be a wash cycle or a rinse cycle, or any other cycle of washing machine 100 in which an additive, such as detergent, fabric softener, pre-wash treatment, bleach, or the like, may be used. As an example, the cycle may be a wash cycle, and initiating the wash cycle may include filling or starting to fill wash basket 120 with water. At step 904, first valve 152 is opened to establish a flow of water to additive reservoir 206 at a first flow rate. Either step 902 or step 904 also may include starting a timer. For example, if the timer is started at step 902, the timer may keep track of a time elapsed since the cycle was initiated. If the timer is started at step 904, the timer may keep track of a time elapsed since first valve 152 was opened.

After a time $t_1$ has elapsed, first valve 152 may be closed, as illustrated at step 906. If the timer was started at step 902, time $t_1$ may be a time elapsed since the cycle was initiated, or if the timer was started at step 904, time $t_1$ may be a time elapsed since first valve 152 was opened. Time $t_1$ is a predetermined time interval that is programmed into controller 108, i.e., time $t_1$ is independent of a flow rate of water through first valve 152. Preferably, the flow rate of water through first valve 152 is such that, regardless of how long first valve 152 stays open, mixture M is siphoned only through first siphon 210. That is, the flow of water from first valve 152 at the first flow rate is insufficient to compensate for the outflow of fluid through first siphon 210.

In any event, first valve 152 is open for a time interval sufficient to establish siphoning of fluid from additive dispenser 200 through first siphon 210. As described above with respect to method 800, water flowing from first valve 152 to additive reservoir 206 through water outlet 156 mixes with additive 208 within reservoir 206 to form a fluid mixture M. First valve 152 is open a time interval sufficient to flow an amount of water to reservoir 206 that raises the fluid level within reservoir 206 to first mixture level $M_1$ shown in FIG. 10 and thereby establishing siphoning through first siphon 210. Because the first peak $P_1$ of first siphon is less than the second peak $P_2$ of second siphon 212 and flow from only first valve 152 does not fill reservoir 206 to second mixture level $M_2$, siphoning is not established through second siphon 212 and mixture M is siphoned only through first siphon 210. As described above, first overflow 228 may help to dispense additive mixture M from additive dispenser 200 to avoid establishing siphoning through second siphon 212. Thus, first overflow 228 may help mitigate the effects of a broad range of pressures experienced by water supply system 150. That is, if the pressure of the water supply is on an upper end of an expected pressure range, the inflow of water to dispenser 200 from first valve 152 may be greater than the outflow of fluid through first siphon 210, but outflow through first overflow 228 in addition to outflow through first siphon 210 can compensate for the inflow of water from first valve 152.

As mixture M is siphoned from additive reservoir 206, mixture M flows through first outlet 214*b* and into dispenser conduit 226, which conveys the mixture M of water and additive 208 toward wash basket 120 and any articles therein. Referring still to FIG. 10, siphoning through first siphon 210 ends when the fluid level within reservoir 206 declines to a first end level $E_1$ at first inlet $I_1$. More specifically, after first valve 152 is closed such that water is not flowing to reservoir 206, the amount of mixture M within reservoir 206 is reduced through the siphoning of mixture M through first siphon 210. At first end level $E_1$, the fluid has reached bottom 218 of first cap 216 such that the fluid pressure of mixture M is insufficient to overcome the pressure within first column 214 and siphoning through first siphon 210 stops. Accordingly, a portion of mixture M has been siphoned through first siphon 210 and dispensed to wash basket 120, and another portion of mixture M remains within reservoir 206.

Opening and closing first valve 152 to flow water at the first flow rate to additive reservoir 206, which mixes with additive 208 within reservoir 206 to form mixture M that is siphoned through first siphon 210, defines a first stage of dispensing additive 208 to wash basket 120. As described above with respect to method 800, as part of the cycle that was initiated at step 902, the contents of wash basket 120 may be agitated, spun, or otherwise manipulated during the first stage of dispensing the additive or before proceeding to the second stage of dispensing the additive. For example, a first portion of water-additive mixture M may be dispensed to wash basket 120 prior to an agitation phase of the wash cycle or as the agitation phase begins. In some embodiments, the contents of wash basket 120 may be agitated after the first portion of mixture M has been dispensed and before another portion of mixture M is dispensed to wash basket 120 as described below.

Referring back to FIG. 9, both first valve 152 and second valve 154 are opened at time $t_2$ to establish a flow of water to additive reservoir 206 at a second flow rate, as illustrated at step 908. It should be appreciated that, by opening both valves 152 and 154 concurrently, the second flow rate of water to dispenser 200 is greater than the first flow rate of water to dispenser 200, i.e., greater than the flow rate when only first valve 152 was open. As shown as step 910, first and second valves 152, 154 then are closed at time $t_3$. Like time $t_1$, if the timer was started when the cycle was initiated, times $t_2$ and $t_3$ may be time periods that have elapsed since the cycle was initiated, or if the time was started when first valve 152 was first opened at step 904, times $t_2$ and $t_3$ may be time periods that have elapsed since the first valve was first opened to dispense water to dispenser 200. Time $t_2$ and time $t_3$ are predetermined time intervals that are programmed into controller 108, i.e., times $t_2$ and $t_3$ are independent of a flow rate of water from first valve 152 and second valve 154. Time $t_2$ is greater than time $t_1$ and time $t_3$ is greater than time $t_2$, such that water is flowed to dispenser 200 at different points or intervals of the cycle.

First valve 152 and second valve 154 are opened together for a time interval sufficient to establish siphoning of fluid from additive dispenser 200 through second siphon 212, as well as first siphon 210. More specifically, water flowing from valves 152, 154 to additive reservoir 206 through water outlet 156 mixes with the water-additive mixture M remaining within reservoir 206, forming more fluid mixture M. Flowing water from both first and second valves 152, 154 raises the fluid level within reservoir 206 to a second mixture level $M_2$ shown in FIG. 11. As described with respect to method 800, at second mixture level $M_2$, the fluid within reservoir 206 has reached an upper inner surface 236 of second cap 222 such that second siphon 212 is primed and siphoning of mixture M is established through second siphon 212. Thus, a larger volume of water is flowed to reservoir 206 with both valves open than with only first valve 152 open, and the larger volume of water raises the fluid level at least to second peak $P_2$ of second siphon 212, which is higher than the first peak $P_1$ of first siphon 210, to establish siphoning through second siphon 212. Further, as the fluid level reaches level $M_1$ as it rises toward level $M_2$, first siphon 210 is primed, and siphoning of mixture M is established through first siphon 210 as well. It will be appreciated that, as described with respect to method 800, second overflow 230 and third overflow 232 may, as needed, help dispense additive mixture M from additive dispenser 200 to avoid overflowing reservoir 206. As mixture M is siphoned from additive reservoir 206, mixture M flows through first outlet 214*b* and second outlet 220*b* and thereby into dispenser conduit 226, which conveys the mixture M of water and additive 208 toward wash basket 120 and any articles therein.

As also illustrated in FIG. 11, siphoning through first siphon 210 ends when the fluid level within reservoir 206 declines to first end level $E_1$. Moreover, because the distance $d_2$ between bottom 224 of second cap 222 and bottom wall 204 of dispenser 200 is less than the distance $d_1$ between bottom 218 of first cap 216 and bottom wall 204, siphoning through second siphon 212 ends when the fluid level within reservoir 206 further declines to a second end level $E_2$, which is closer to bottom wall 204 than is first end level $E_1$. At second end level $E_2$, the fluid level has dropped to second inlet $I_2$ such that the fluid pressure of mixture M is insufficient to overcome the pressure within second column 220 and siphoning through second siphon 212 stops. Accordingly, a second portion of mixture M has been siphoned through first and second siphons 210, 212 and dispensed to wash basket 120, and only a small portion of mixture M remains within reservoir 206.

As a result, a second stage of dispensing additive 208 to wash basket 120 is defined by opening and closing first and second valves 152, 154 to flow water to additive reservoir 206 at the second flow rate and thereby form additional mixture M that is siphoned through first and second siphons 210, 212 and flows to wash basket 120. Therefore, by utilizing siphons 210, 212 having different peak heights $P_1$, $P_2$, an additive can be dispensed from additive dispenser 200 in a first stage and a second stage, which are based on the flow rate of water delivered to reservoir 206. That is, water may be delivered to the dispenser at different flow rates to dispense the additive in multiple stages.

Moreover, at step 912, the cycle of washing machine appliance 100 is completed. For example, if the cycle is a wash cycle, the contents of wash basket 120 can be agitated for a period of time; in some embodiments, the second stage of dispensing additive 208 occurs during the agitation phase of the wash cycle, such that the agitation phase is completed after the second stage of dispensing. After the agitation phase of the wash cycle is completed, wash basket 120 can be drained. Other cycles, such as a rinse cycle and a spin cycle, may then be performed.

As described, the time intervals $t_1$, $t_2$, and $t_3$ are predetermined time intervals that are not based on the flow rate of water determined using flow meter 158. Rather, first valve 152 and second valve 154, and/or first siphon 210 and second siphon 212, are selected such that siphoning occurs only through first siphon 210 when only first valve 152 is open and siphoning occurs through both first and second siphons 210, 212 when both first and second valves 152, 154 are open. Further, first and second valves 152, 154 and first and second siphons 210, 212 may be selected such that method 900 performs as described across a wide range of water supply pressures, such as the pressure ranges described above. Accordingly, method 900 may be less sensitive to the water supply pressure range than other methods of operating washing machine appliance 100 to dispense an additive.

Figure 12:
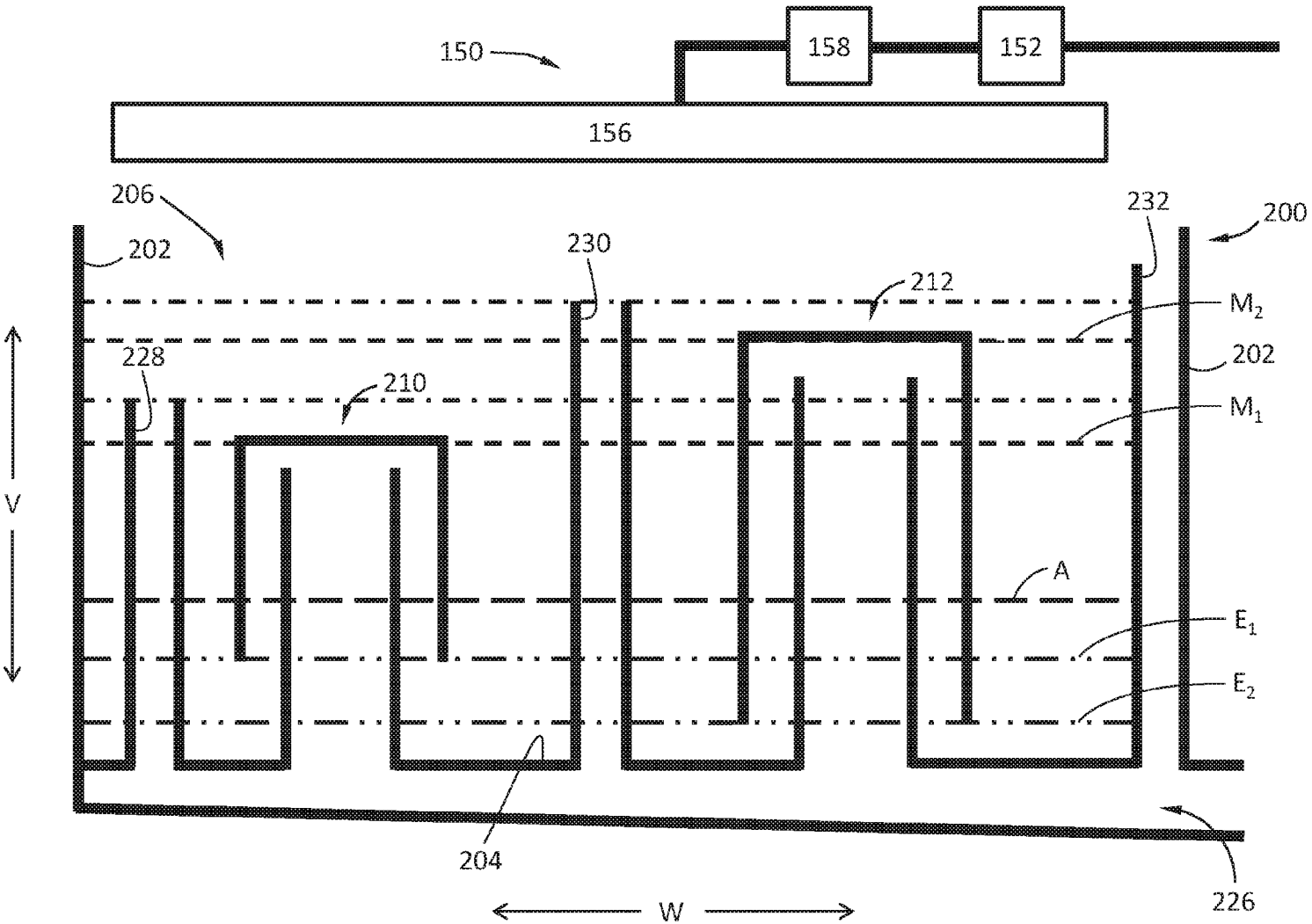
FIGS. 12 and 13 provide schematic views of an additive dispenser and a water supply system according to other exemplary embodiments of the present subject matter.
Figure 13:
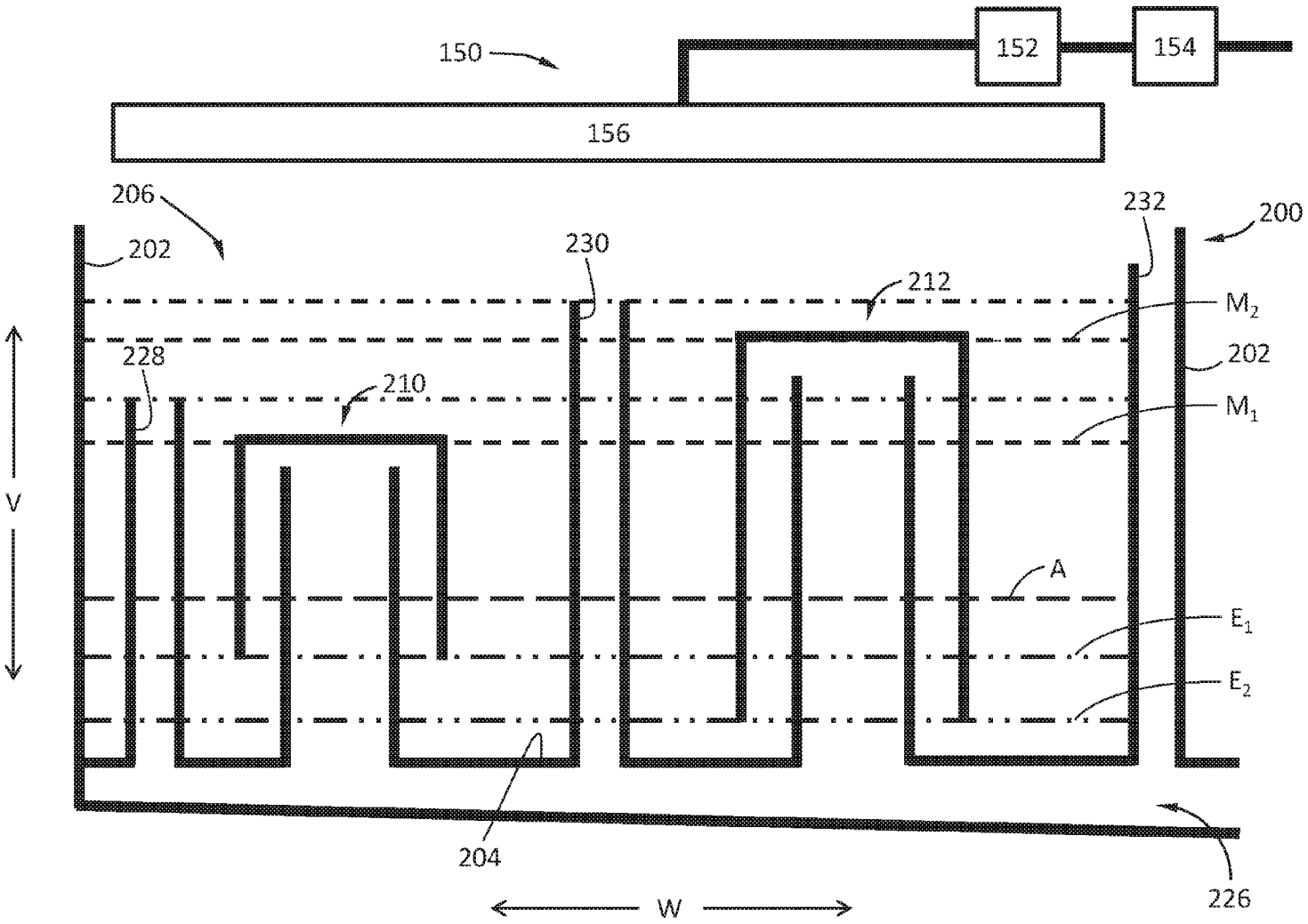

FIGS. 12 and 13 provide schematic views of additive dispenser 200 and water supply system 150 according to other exemplary embodiments of the present subject matter. Referring to FIG. 12, as described above, method 800 utilizes only one water valve to provide water to dispenser 200; therefore, water supply system 150 may include flow meter 158 and only one valve 152 as shown in FIG. 12. In appropriate embodiments, flow meter 158 also may be omitted, such that water supply system 150 includes valve 152 and water outlet 156 without a second valve 154 or flow meter 158. Turning to FIG. 13, as previously described, method 900 utilizes first valve 152 and second valve 154 to provide water to dispenser 200 and does not require flow meter 158. Accordingly, flow meter 158 may be omitted as shown in FIG. 13, such that water supply system 150 comprises first valve 152, second valve 154, and water outlet 156. Of course, in other embodiments of water supply system 150, other configurations of valves 152, 154, flow meter 158, and water outlet 156 may be used.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An additive dispenser for a washing machine appliance, the additive dispenser defining a vertical direction and a width direction, the additive dispenser comprising:

sidewalls and a bottom wall, the sidewalls and the bottom wall defining an additive reservoir;

a first siphon positioned within the additive reservoir, the first siphon including a first column and a first cap, the first column and the first cap defining a first peak, the first cap having a bottom positioned a first distance from the bottom wall to define a first inlet;

a second siphon positioned within the additive reservoir, the second siphon including a second column and a second cap, the second column and the second cap defining a second peak, the second cap having a bottom positioned a second distance from the bottom wall to define a second inlet;

a plurality of overflow passages, the plurality of overflow passages including a first overflow having a first height and a second overflow having a second height, wherein the first peak is defined at a lower vertical height than the second peak, wherein the first inlet is defined at a greater vertical height than the second inlet, wherein the first height of the first overflow is greater than the first peak and less than the second peak, and wherein the second height of the second overflow is greater than the second peak.

* * * * *